US007159429B2

(12) United States Patent
Takemasu et al.

(10) Patent No.: US 7,159,429 B2
(45) Date of Patent: Jan. 9, 2007

(54) METHOD AND DEVICE FOR MANUFACTURING BOLT, SCREW ROLLING DIE USED THEREFOR, AND MULTIPLE SCREW BOLT

(75) Inventors: Teruie Takemasu, Fukuoka (JP); Hiroshi Miyahara, Fukuoka (JP)

(73) Assignee: Kyushu TLO Company, Limited, Fukuoka (JP)

( * ) Notice: Subject to any disclaimer, the term of this patent is extended or adjusted under 35 U.S.C. 154(b) by 0 days.

(21) Appl. No.: 10/549,898

(22) PCT Filed: Mar. 19, 2004

(86) PCT No.: PCT/JP2004/003788

§ 371 (c)(1),
(2), (4) Date: Sep. 20, 2005

(87) PCT Pub. No.: WO2004/085093

PCT Pub. Date: Oct. 7, 2004

(65) Prior Publication Data

US 2006/0225477 A1 Oct. 12, 2006

(30) Foreign Application Priority Data

Mar. 24, 2003 (JP) ..... 2003-081247
Oct. 10, 2003 (JP) ..... 2003-352624

(51) Int. Cl.
*B21H 3/04* (2006.01)

(52) U.S. Cl. ..... 72/103; 470/10; 470/66; 470/70; 470/185; 72/104

(58) Field of Classification Search ..... 72/103, 72/104, 108, 88, 469; 411/412, 413; 470/9, 470/10, 11, 66, 70, 84, 185
See application file for complete search history.

(56) References Cited

U.S. PATENT DOCUMENTS 4,237,948 A * 12/1980 Jones et al. ..... 411/307
6,149,363 A * 11/2000 March ..... 411/366.1
6,216,510 B1 * 4/2001 Hashimoto ..... 72/103
2003/0156921 A1 * 8/2003 Nagawa et al. ..... 411/411

FOREIGN PATENT DOCUMENTS

JP 2003-232326 8/2003
JP 2003-260532 9/2003
WO 02/077466 10/2002

* cited by examiner

*Primary Examiner*—Ed Tolan
(74) *Attorney, Agent, or Firm*—Wenderoth, Lind & Ponack, L.L.P.

(57) ABSTRACT

A method and apparatus for manufacturing a bolt capable of mass-producing a multiple screw bolt such as a so-called double screw bolt at a low unit price, and a thread rolling die for use therein. The apparatus for manufacturing a bolt comprises a pair of thread rolling dies (1) which are arranged opposite to each other at a predetermined interval, and a bolt supporting unit (2) which supports a cylindrical bolt material (3) in a predetermined position. The thread rolling dies (1) are provided with a transfer pattern (4) having a coarse thread portion (5) which is part of a coarse thread formed by developing a coarse screw, and projections (6) which are part of a fine thread (6*a*) formed by developing a fine screw as shown by an imaginary line (6*a*), the fine thread (6*a*) being formed cyclically on a root portion (5*a*) of the coarse thread according to a phase shift between the fine thread and the coarse thread.

16 Claims, 12 Drawing Sheets

METHOD AND DEVICE FOR MANUFACTURING BOLT, SCREW ROLLING DIE USED THEREFOR, AND MULTIPLE SCREW BOLT

This application is a 35 USC 371 of PCT/JP04/03788 filed Mar. 19, 2004.

1. Technical Field

The present invention relates to a method and apparatus for manufacturing a bolt having an anti-loosening function, a thread rolling die for use therein, and a multiple screw bolt.

2. Background Art

In recent years, research and development have been conducted on various types of bolts having anti-loosening functions and methods of manufacturing the same. For example, International Publication Pamphlet No. 02/077466 (hereinafter, referred to as "patent document 1") describes a bolt which comprises a coarse screw portion having a pitch of P, formed from the extremity to a predetermined part of the bolt shank, and a fine screw portion having a pitch of p (p=P/n; n is an integer no smaller than 2), formed at least over the entire length of the coarse screw portion of the bolt shank or so as to overlap with the coarse screw portion from the extremity to a predetermined part of the coarse screw portion.

With this bolt (so-called double screw bolt), a coarse nut is threadedly engaged with the coarse screw portion of the bolt and then a fine nut is threadedly engaged with the fine screw portion in addition to this coarse nut, so that the bolt and the two nuts can be fastened to each other. Here, since the fine nut and the coarse nut have different pitches, a repulsive force occurs on the contact surface (bearing surface) between the two nuts when the two rotate together in the same direction. This makes it possible to prevent the coarse nut from rotating in a loosening direction.

Patent document 1 also describes a method of manufacturing this double screw bolt. In the manufacturing method, the coarse screw portion having the pitch P is initially formed from the extremity to the predetermined part of the bolt shank by cutting, and then the fine screw portion having the pitch p is formed at least over the entire length of the coarse screw portion of the bolt shank or so as to overlap with the coarse screw portion from the extremity of the bolt shank to the predetermined part of the coarse screw portion by cutting.

DISCLOSURE OF THE INVENTION

As described above, when a coarse screw portion is initially formed by cutting and then a fine screw portion is formed over this coarse screw portion by cutting, two cutting steps must be performed in order to manufacture a single double screw bolt. Besides, when the coarse screw portion formed by the first cutting is subjected again to the second cutting to form the fine screw portion, the areas cut twice can cause burrs. This requires the step of removing the burrs by using a wire brush or the like.

Moreover, the patent document 1 makes mention of manufacturing a double screw bolt in a single step of rolling by using a coarse die and a fine die. Nevertheless, even if a coarse die and a fine die are arranged opposite to each other across a certain interval and a bolt shank is put and rolled between the coarse die and fine die as described in the patent document 1, it is actually impossible to manufacture a double screw bolt. The reason for this is that a thread rolled by one of the dies (either coarse or fine) is collapsed by the other die (either fine or coarse).

Furthermore, the patent document 1 describes that a die having both a coarse thread and a fine thread integrally formed thereon can also be used in practice, whereas the patent document 1 includes no description of exactly how the coarse thread and the fine thread can be formed integrally. While the expression of a die having both a coarse thread and a fine thread is seemingly correct, it is in fact impossible to form both a coarse thread and a fine thread on a single die integrally. Based on the description of the patent document 1 alone, it is thus impossible to manufacture the double screw bolt.

As above, the double screw bolt described in the patent document 1 can actually be manufactured by no other means than by cutting. Since the cutting-based manufacturing method as described above includes a greater number of manufacturing steps than for ordinary bolts, however, the cost of manufacturing is extremely high and the double screw bolt comes at a very high unit price.

It is thus an object of the present invention to provide a method and apparatus for manufacturing a bolt capable of mass-producing a multiple screw bolt such as a so-called double screw bolt at a low unit price, and a thread rolling die for use therein.

To solve the foregoing problems, a thread rolling die of the present invention comprises: part of a coarse thread formed by developing a coarse screw; and part of a fine thread formed by developing a fine screw, the fine thread being formed cyclically on a root portion of the coarse thread according to a phase shift between the fine thread and the coarse thread. An apparatus for manufacturing a bolt of the present invention is an apparatus for manufacturing a bolt by pressing a bolt material against thread rolling dies for rolling, wherein at least one of the thread rolling dies is the foregoing thread rolling die of the present invention. A method of manufacturing a bolt of the present invention is a method of manufacturing a bolt by pressing a bolt material against thread rolling dies for rolling, wherein at least one of the thread rolling dies is the foregoing thread rolling die of the present invention.

According to the method and apparatus for manufacturing a bolt of the present invention, the bolt material is pressed by the part of the coarse thread and the part of the fine thread formed on the thread rolling die. The part of the coarse thread on the thread rolling die transfers the part of the coarse thread to the peripheral surface of the bolt material, and the part of the fine thread on the thread rolling die transfers the part of the fine thread to the part of the coarse thread on the peripheral surface of the bolt material, in a single step at a time. Consequently, a bolt having so-called double screws, on which both the part of the coarse thread and the part of the fine thread are formed, is obtained.

Here, the coarse screw refers to one that has a typical combination of a diameter and a pitch and is in most common use. The fine screw refers to one that has a pitch having a finer ratio to its diameter and has a shallower root as compared with the coarse screw. The fine thread according to the thread rolling die of the present invention has only to have a pitch smaller than that of the coarse thread. The individual threads may have any configuration including those of triangular screws, trapezoidal screws, square screws, buttress screws, round screws, pole screws, and other special screws, or any optional combination of the same.

Incidentally, as employed in this description, a multiple screw refers to a cylindrical body or conical body having two or more coaxial threads that have their helical lines in an identical direction and have different pitches. A multiple screw is called a double screw when the number of threads having different pitches is two, a triple screw when three, a quadruple screw when four, . . . , and an n-fold screw when n. Assuming that the ratio between the thread having the largest pitch and the thread having the smallest pitch of a multiple screw is (a) to (n) ((a) and (n) are in a minimum integer ratio), the multiple screw varies in thread shape cyclically at regular pitches a of the large-pitch thread.

In manufacturing a double screw bolt, the thread rolling die shall have: part of a coarse thread formed by developing a coarse screw; and part of a fine thread which appears cyclically on a root portion of this coarse thread at every (b) turns of the coarse thread according to a phase shift from the coarse thread when a fine screw having a helical line in the same direction as that of the coarse screw and a pitch smaller than that of the coarse screw (where the ratio between the pitches of the coarse screw and the fine screw is (a) to (b); (a) and (b) are in a minimum integer ratio) is developed.

The thread rolling die may further have part of a finest thread which appears cyclically on a root portion formed by the part of the coarse thread and the part of the fine thread at every (c) turns of the coarse thread according to phase shifts from the part of the coarse thread and the part of the fine thread when a finest screw having a helical line in the same direction as that of the coarse screw and a pitch even smaller than that of the fine screw (where the ratios among the pitches of the coarse screw, the fine screw, and the finest screw are (a) to (b) to (c); (a), (b) and (c) are in minimum integer ratios) is developed. This makes it possible to manufacture a triple screw bolt on which the part of the coarse thread, the part of the fine thread, and the part of the finest thread are formed.

Furthermore, in manufacturing an n-fold screw bolt, the thread rolling die shall have: part of a coarse thread formed by developing a coarse screw; and part of each of fine threads which appear cyclically on a root portion of this coarse thread at (n) turns of the coarse thread according to phase shifts from the coarse thread when one or a plurality of fine screws having helical lines in the same direction as that of the coarse screw and respective different pitches smaller than that of the coarse screw (where the ratios among the pitches of the coarse screw and the one or plurality of fine screws are (a) to . . . to (n); (a), . . . , and (n) are in minimum integer ratios) are developed, respectively. This makes it possible to manufacture a multiple screw bolt on which the part of the coarse thread and the part of each of the plurality of fine threads are formed.

Suppose here that the part of the fine thread having the smallest pitch among the fine threads appears cyclically at every (n) turns of the coarse thread according to a phase shift from the coarse thread when the fine screw is developed so that the root of the fine screw developed lies in a position higher than the root of the coarse thread. Then, at the time of rolling, the rolling pitch circle diameter moves toward the inside of the bolt material approximately half as much as the root is made higher in the root portion of the fine screw developed. This decreases variations of the rolling pitch circle diameter in the final phase of machining, thereby reducing fluctuations of the position of the rotation center of the bolt material.

Here, it is also desirable that the root of the fine screw developed is positioned higher than the root of the coarse thread by 5% to 50% the height of the fine thread according to standards. In this range, chatter vibrations and noise can be reduced effectively. Incidentally, below 5%, the change in the root height produces little improvement to chatter vibrations and noise. Above 50%, on the other hand, the height of the fine thread of the multiple screw bolt manufactured by rolling falls below the pitch diameter of the fine thread according to standards, so that engagement with the fine thread of this multiple screw bolt becomes smaller.

The thread rolling die may also have a deep groove further into the root of the part of the fine thread. Then, in rolling a multiple screw bolt, this deep groove functions as a dashpot, so that the multiple screw bolt having fine screw dimensions according to standards can be manufactured even when the bolt material is not filled into the groove portion of the thread rolling die completely. Besides, the incomplete fill can suppress chatter vibrations in the final phase of machining, which occur from such factors as complete fill.

Moreover, the groove here is desirably given a depth 3% to 10% the height of the fine thread according to standards. In this range, it is possible to exercise the dashpot function sufficiently and manufacture a multiple screw bolt having a fine thread of perfect shape, and suppress chatter vibrations in the final phase of machining sufficiently. Incidentally, below 3%, the provision of the groove produces little improvement. Above 10%, on the other hand, the groove is so deep that it may affect the shape of the fine thread of the multiple screw bolt.

Suppose now that the thread rolling die of the present invention is a circular die on which the part of the coarse thread and the part of the fine thread are formed. Then, a double screw bolt can be manufactured by arranging a plurality of these thread rolling dies at a predetermined interval, and rotating them in the same direction so that a bolt material is pressed between these thread rolling dies.

Moreover, suppose that the thread rolling die of the present invention is a flat die on which the part of the coarse thread and the part of the fine thread are formed. Then, a double screw bolt can be manufactured by arranging a plurality of these thread rolling dies at a predetermined interval, and fixing one and moving the other in parallel, or moving both in opposite directions in parallel, so that a bolt material is pressed between these thread rolling dies.

Incidentally, the thread rolling die of the present invention has only to be arranged at least as one of the plurality of thread rolling dies to be arranged at a predetermined interval, whereas all the thread rolling dies may be the thread rolling dies of the present invention. When one of the thread rolling dies is the thread rolling die of the present invention, the other thread rolling die(s) shall be an ordinary coarse screw die(s) on which a coarse screw alone is developed. Moreover, when applied to a method or apparatus for manufacturing a bolt of rotary planetary system, the thread rolling die of the present invention may be applied to either one or both of the circular die and the segment die.

The present invention achieves the following effects.

(1) There is provided at least one thread rolling die that has: part of a coarse thread formed by developing a coarse screw; and part of a fine thread formed by developing a fine screw, the fine thread being formed cyclically on a root portion of the coarse thread according to a phase shift between the fine screw and the coarse screw. A bolt material is pressed and rolled against the thread rolling die. With this configuration, the bolt material is pressed by the part of the coarse thread and the part of the fine thread formed on the thread rolling die, so that the part of the coarse thread and the part of the fine thread are transferred to the peripheral surface of this bolt material in a single step at a time. This makes it possible to mass-produce a bolt having so-called double screws, provided with the part of the coarse thread and the part of the fine thread, at a unit price lower than by cutting.

(2) There is provided at least one thread rolling die that has: part of a coarse thread formed by developing a coarse screw; and part of a fine thread which appears cyclically on a root portion of this coarse thread at every (b) turns of the coarse thread according to a phase shift from the coarse thread when a fine screw having a helical line in the same direction as that of the coarse screw and a pitch smaller than that of the coarse screw (where the ratio between the pitches of the coarse screw and the fine screw is (a) to (b); (a) and (b) are in a minimum integer ratio) is developed. A bolt material is pressed and rolled against the thread rolling die. With this configuration, the bolt material is pressed by the part of the coarse thread and the part of the fine thread formed on the thread rolling die, so that the part of the coarse thread and the part of the fine thread are transferred to the peripheral surface of this bolt material in a single step at a time. This makes it possible to mass-produce a so-called double screw bolt, provided with the part of the coarse thread and the part of the fine thread, at a unit price lower than by cutting.

(3) There is provided at least one thread rolling die that further has part of a finest thread which appears cyclically on a root portion formed by the part of the coarse thread and the part of the fine thread at every (c) turns of the coarse thread according to phase shifts from the part of the coarse thread and the part of the fine thread when a finest screw having a helical line in the same direction as that of the coarse screw and a pitch even smaller than that of the fine screw (where the ratios among the pitches of the coarse screw, the fine screw, and the finest screw are (a) to (b) to (c); (a), (b) and (c) are in minimum integer ratios) is developed. A bolt material is pressed and rolled against the thread rolling die. With this configuration, the bolt material is pressed by the part of the coarse thread, the part of the fine thread, and the part of the finest thread formed on the thread rolling die, so that the part of the coarse thread, the part of the fine thread, and the part of the finest thread are transferred to the peripheral surface of this bolt material in a single step at a time. This makes it possible to mass-produce a so-called triple screw bolt, provided with the part of the coarse thread, the part of the fine thread, and the part of the finest thread, at a unit price lower than by cutting.

(4) There is provided at least one thread rolling die that has: part of a coarse thread formed by developing a coarse screw; and part of each of fine threads which appear cyclically on a root portion of this coarse thread at every (n) turns of the coarse thread according to phase shifts from the coarse thread when one or a plurality of fine screws having helical lines in the same direction as that of the coarse screw and respective different pitches smaller than that of the coarse screw (where the ratios among the pitches of the coarse screw and the plurality of fine screws are (a) to . . . to (n); (a), . . . , and (n) are in minimum integer ratios) are developed, respectively. A bolt material is pressed and rolled against the thread rolling die. With this configuration, the bolt material is pressed by the part of the coarse thread and the part of the plurality of fine threads formed on the thread rolling die, so that the part of the coarse thread and the part of each of the plurality of fine threads are transferred to the peripheral surface of this bolt material in a single step at a time. This makes it possible to mass-produce a so-called multiple screw bolt, provided with the part of the coarse thread and the part of each of the plurality of fine threads, at a unit price lower than by cutting.

(5) The part of the fine thread having the smallest pitch among the fine threads appears cyclically at every (n) turns of the coarse thread according to a phase shift from the coarse thread when the fine screw is developed so that the root of the fine screw developed lies in a position higher than the root of the coarse thread. At the time of rolling, this decreases variations of the rolling pitch circle diameter in the final phase of machining, thereby reducing fluctuations in the position of the rotation center of the bolt material. The material filling factors to groove portions of the thread rolling die thus become more uniform, allowing significant suppression of chatter vibrations.

(6) The thread rolling die has a deep groove further into the root of the part of the fine thread. This makes it possible to manufacture a multiple screw bolt that has a fine thread having the same height as that of the fine thread of the thread rolling die even if the groove portions of the thread rolling die are not filled with the bolt material completely during the rolling of the multiple screw bolt. In addition, the incomplete fill can suppress chatter vibrations in the final phase of machining, which occur from such factors as complete fill.

(7) The rolling using the thread rolling die of the present invention produces a double screw bolt in which the coarse thread and the fine thread(s) form borders having smooth curvatures at their extremities. Unlike double screw bolts manufactured by cutting, the borders between the coarse thread and the fine thread(s) have no edge.

BEST MODE FOR CARRYING OUT THE INVENTION (Embodiment 1)

Figure 1:
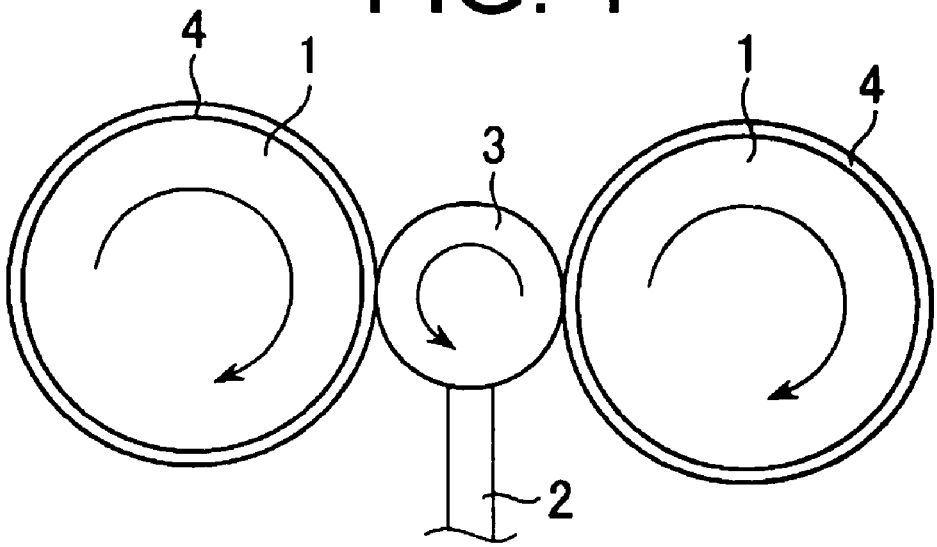
FIG. 1 is a schematic diagram showing an apparatus for manufacturing a double screw bolt according to a first embodiment of the present invention.
Figure 2:
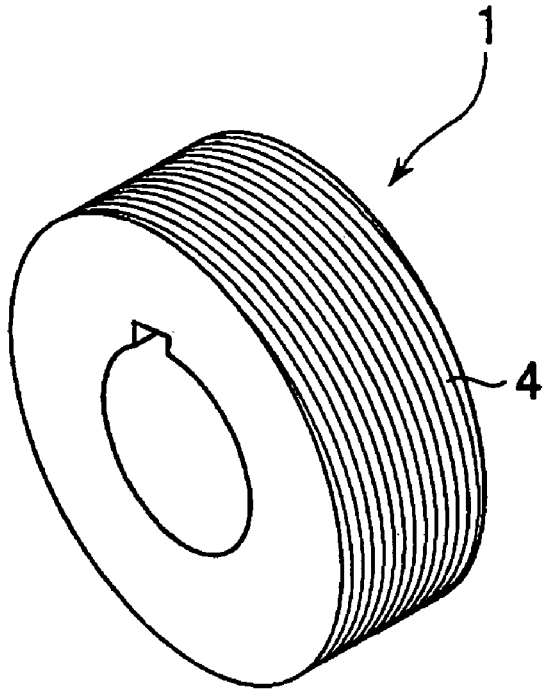
FIG. 2 is a perspective view showing a thread rolling die of FIG. 1.

FIG. 1 is a schematic diagram showing an apparatus for manufacturing a double screw bolt according to a first embodiment of the present invention. FIG. 2 is a perspective view showing a thread rolling die 1 of FIG. 1.

As shown in FIG. 1, the apparatus for manufacturing a double screw bolt according to the present embodiment comprises a pair of the thread rolling dies 1 which are arranged opposite to each other at a predetermined interval, and a bolt supporting unit 2 which supports a cylindrical bolt material (hereinafter, referred to as "work") 3 in a predetermined position. As shown in FIG. 2, the thread rolling dies 1 are dies of cylindrical shape (cylindrical dies) on the peripheries of which a transfer pattern 4 for forming a double screw bolt is formed.

Figure 3:
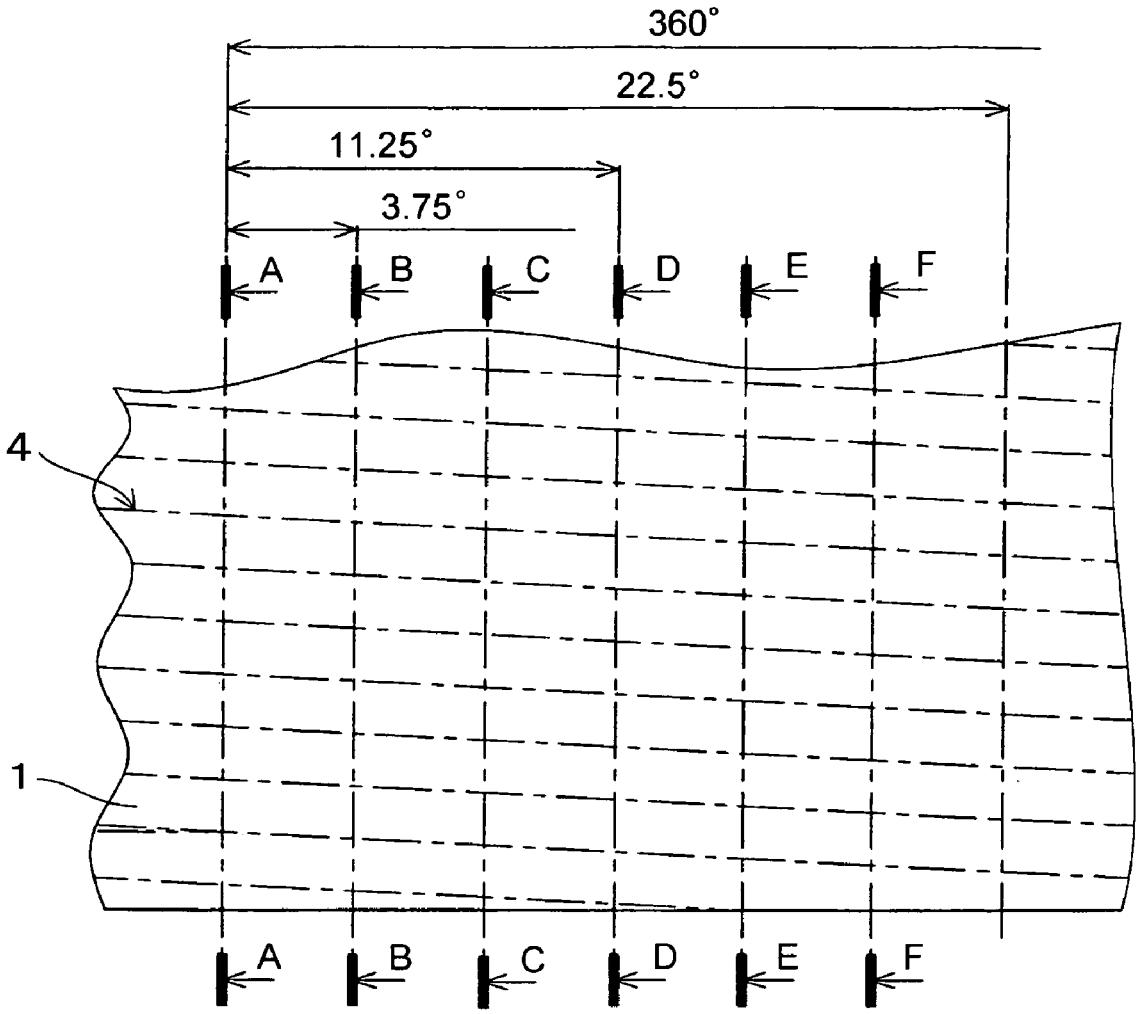
FIG. 3 is a diagram showing part of a transfer pattern on the periphery of the thread rolling die of FIG. 2, developed on a plane.

FIG. 3 is a diagram showing part of the transfer pattern 4 on the periphery of the thread rolling die 1 of FIG. 2, developed on a plane. FIGS. 4A, 4B, 4C, 4D, 4E, and 4F are sectional views taken along the lines A—A, B—B, C—C, D—D, E—E, and F—F of FIG. 3, respectively.

As shown in FIG. 3, the transfer pattern 4 corresponding to the double screw bolt to manufacture is formed to repeat 16 times per round on the periphery of the thread rolling die 1. The thread rolling die 1 has an outer diameter of 173.987 nun, and the double screw bolt has a nominal diameter of M12, a coarse screw pitch of 1.75 mm, and a fine screw pitch of 0.875 mm. It follows that the transfer pattern 4 for a single round of double screw bolt is formed to range between 22.5 degrees out of a single round 360 degrees of the periphery of the thread rolling die 1. The lines A—A, B—B, C—C, D—D, E—E, and F—F of FIG. 3 are spaced at every 3.75 degrees.

As shown in FIGS. 4A to 4F, the transfer pattern 4 of the thread rolling die 1 (shown by a solid line in FIGS. 4A to 4F) is composed of part 5 of a coarse thread (hereinafter, referred to as "coarse thread portion") which is a reference thread formed by developing a coarse screw on the surface of a cylindrical die, and additional projections 6 which are formed cyclically on a root portion 5*a* of this coarse thread. The projections 6 are formed in a cyclic configuration according to a phase shift 7 between a fine thread (shown by a dotted line (imaginary line) 6*a* in FIGS. 4A to 4F) formed by developing a fine screw that has a helical line in the same direction as that of the original coarse screw of the coarse thread developed and has a pitch smaller than that of the coarse screw, and the coarse thread.

Assuming here that the ratio between the pitches of the coarse screw and the fine screw is (a) to (b) (where (a) and (b) are in a minimum integer ratio; in the shown example, 2 to 1), the projections 6 make part of the fine thread which appears cyclically at every (b) turns (in the shown example, each single turn) of the coarse thread according to a phase shift from the coarse thread when the fine screw is developed. As shown in FIGS. 4A to 4F, the fine thread shown by the imaginary line 6*a* appears as the additional projections 6, only at portions that protrude from the coarse thread due to the phase shift 7 from this coarse thread. In other words, the projections 6 are not the fine thread itself, but projections protruded further from the coarse thread so as to correspond to the imaginary line 6*a* of the fine thread as much as the respective amounts of shift according to the phase shift 7. The coarse thread portion 5 is one excluding the part of the fine thread (the surfaces of the projections 6) appearing on the surface of the thread rolling die 1.

In the example shown in FIGS. 4A to 4F, the root 5*b* of the root portion 5*a* of the reference coarse thread and the root 6*b* of the imaginary line 6*a* of the fine thread corresponding to the projections 6 are matched with each other in position. This is not restrictive, however.

For example, when a coarse nut is threaded with the coarse thread of a double screw bolt (not shown) that is manufactured with the thread rolling dies 1 of the present embodiment, the contact area decreases as much as the projections 6 of the thread rolling dies 1. Nevertheless, the root 6*b* of the imaginary line 6*a* of the fine thread corresponding to the projections 6 can be moved in position downward in FIGS. 4A to 4F, so that the contact area between the coarse thread of the double screw bolt and the coarse nut increases.

Incidentally, ordinary thread rolling dies have either a coarse thread or a fine thread alone, and it is therefore possible to engage a coarse thread nut or a fine thread nut with the same. In the case of the thread rolling die 1 of the present embodiment, however, either a coarse thread nut or a fine thread nut will not fit at all. The reason for this is that what the surface of the thread rolling die 1 have are the coarse thread portion 5 and the projections 6 of cyclic configuration formed on the root portion 5*a* of the original coarse thread of this coarse thread portion 5, not the conventional coarse thread and fine thread formed integrally as described in the patent document 1 (though the specific structure thereof is unknown).

To manufacture a double screw bolt by using the apparatus for manufacturing a double screw bolt of the foregoing configuration, a cylindrical work 3 is placed on the bolt supporting unit 2. This work 3 is pressed between the pair of thread rolling dies 1, and the pair of thread rolling dies 1 are individually rotated in the same direction (for example, clockwise as shown by the arrows in FIG. 1). As a result, part of the coarse thread and part of the fine thread are transferred to the peripheral surface of the work 3 in a single step at a time, whereby a double screw bolt having part of the coarse thread portion and part of the fine thread portion is obtained.

The peripheral surface of the double screw bolt obtained is thus provided with grooves in a pattern inverse to the transfer pattern 4 on the thread rolling die 1 of FIGS. 4A to 4F (grooves corresponding to the coarse thread portion 5 and the projections 6).

Like a double screw bolt formed by conventional cutting, the resultant double screw bolt has a coarse thread from which a fine thread is cut away. Consequently, both a coarse thread nut and a fine thread nut can be engaged with the resultant double screw bolt.

Incidentally, the double screw bolt is such that the thread portion of the coarse thread of a coarse thread nut is fitted into the root portion of the coarse thread of this double screw bolt, and the thread portion of the fine thread of a fine thread nut is fitted into the root portion of the fine thread formed in the thread portion of the coarse thread of this double screw bolt. The double screw bolt is thus typically formed so that the radial position of the crest of the coarse thread and the radial position of the crest of the fine thread coincide with each other all the time. The projections of the thread rolling dies for manufacturing such a double screw bolt are made of part of a fine thread which appears cyclically at every (b) turns of the coarse thread according to a phase shift from the coarse thread when a fine screw is developed so that the position of the root of the fine screw developed coincides with the position of the root of the coarse thread. Hereinafter, a thread rolling die having projections like these will be referred to as "standard die."

Figure 4A:
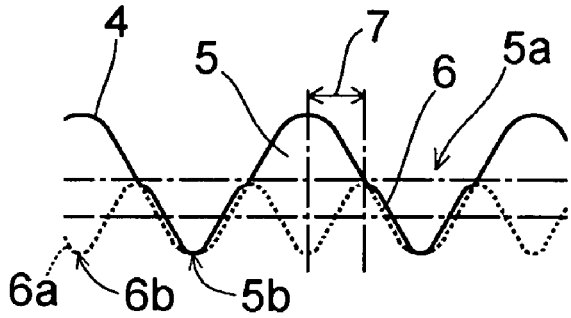
FIG. 4A is a sectional view taken along the line A—A of FIG. 3.
Figure 4B:
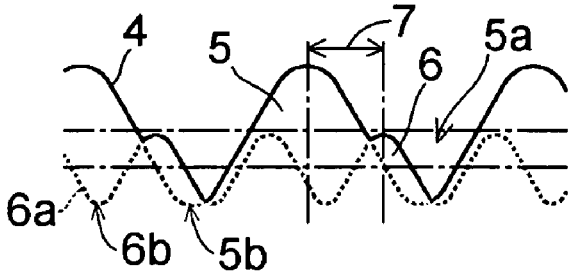
FIG. 4B is a sectional view taken along the line B—B of FIG. 3.
Figure 4C:
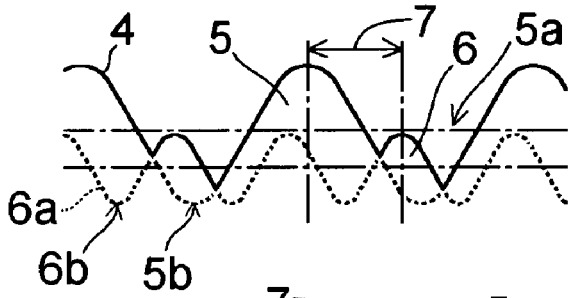
FIG. 4C is a sectional view taken along the line C—C of FIG. 3.
Figure 4D:
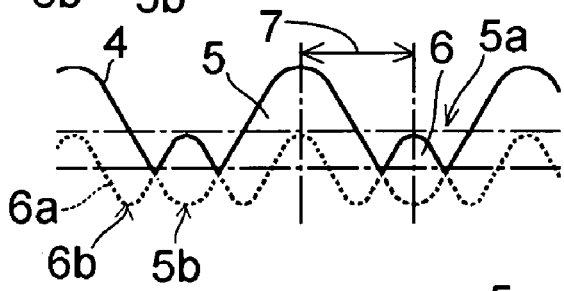
FIG. 4D is a sectional view taken along the line D—D of FIG. 3.
Figure 4E:
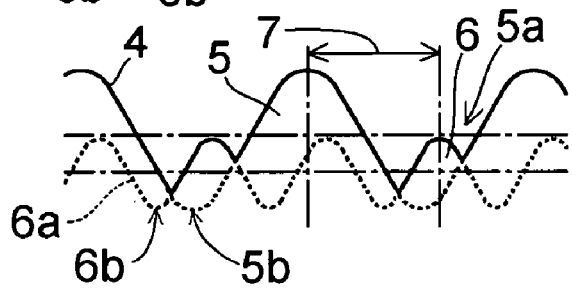
FIG. 4E is a sectional view taken along the line E—E of FIG. 3.
Figure 4F:
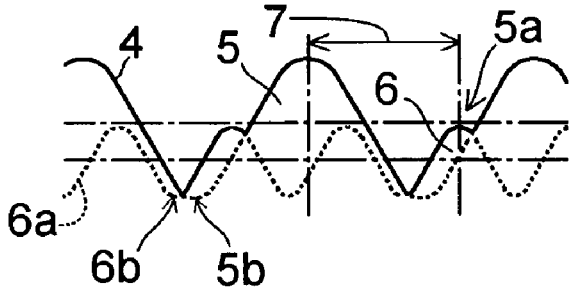
FIG. 4F is a sectional view taken along the line F—F of FIG. 3.
Figure 5A:
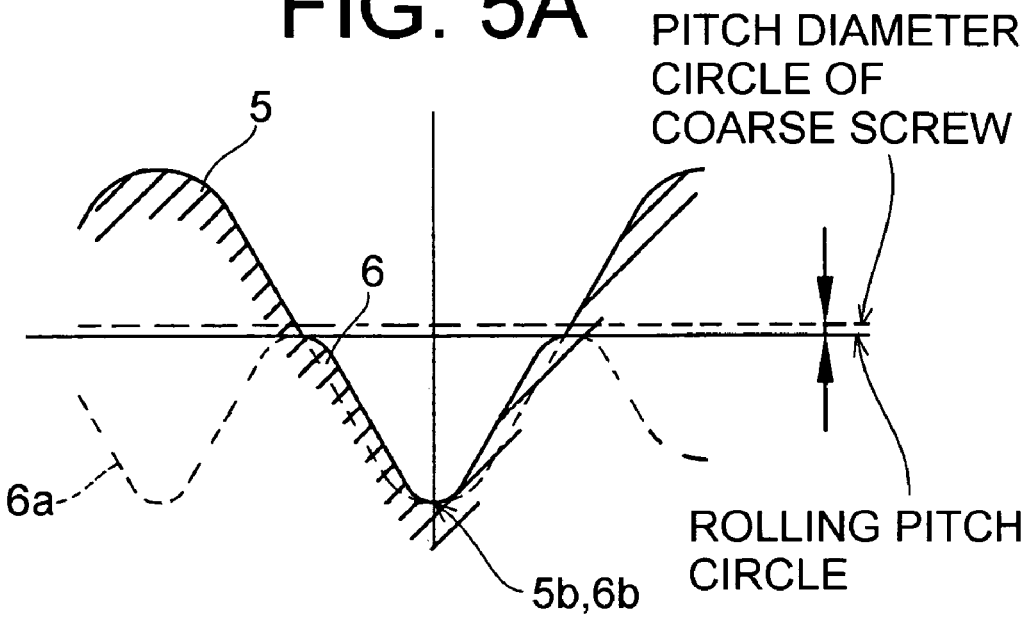
FIG. 5A is an enlarged partial view of FIG. 4A.
Figure 5B:
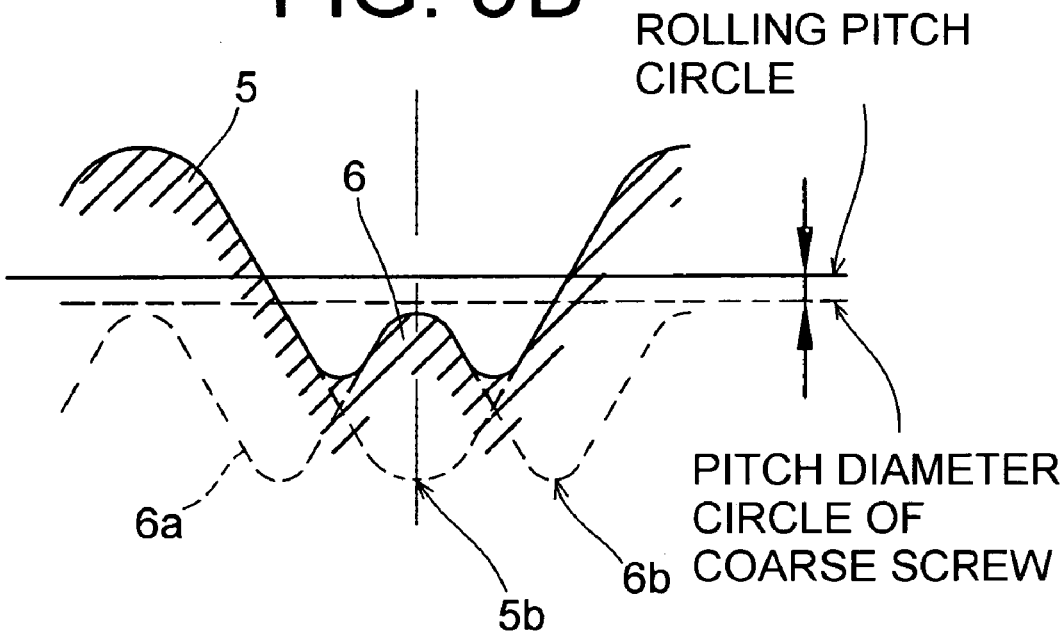
FIG. 5B is an enlarged partial view of FIG. 4D.

FIGS. 5A and 5B are enlarged partial views of FIGS. 4A and 4D, respectively. As shown in FIGS. 5A and 5B, the cyclically-changing depth of the groove of the standard die reaches a maximum in areas where the position of the root 5*b* of the coarse thread and the position of the root 6*b* of the fine thread 6*a* of the fine screw developed to form the projections 6 overlap the most with each other (A—A section), and reaches a minimum in areas where the positions of the two differ the most from each other (D—D section). Consequently, in rolling a double screw bolt with standard dies, the diameter of the rolling pitch (the position where tools and the work 3 make rolling contact) circle between the tools and the work 3 in the final phase of machining reaches a maximum in the areas of the A—A section, and a minimum in the areas of the D—D section, as viewed from the work 3.

As a result, at the time of machining (i.e., in the final run-in phase of machining), the rotation center of the work 3 fluctuates in position all the time, thereby causing high chatter vibrations and noise. Depending on the level, the chatter vibrations may cause poor precision, a significant reduction in tool life, and adverse effects on the manufacturing apparatus. Moreover, in these standard dies, the grooves have different sectional areas in the respective cross-sections (i.e., the A—A section is the maximum and the D—D section the minimum). This causes differences between the material filling factors to the grooves in the respective cross-sections. In the final phase of machining in particular, high material filling factors to the grooves eliminate escapes for redundant material. This also contributes to the problems of chatter vibrations and the like.

Figure 6A:
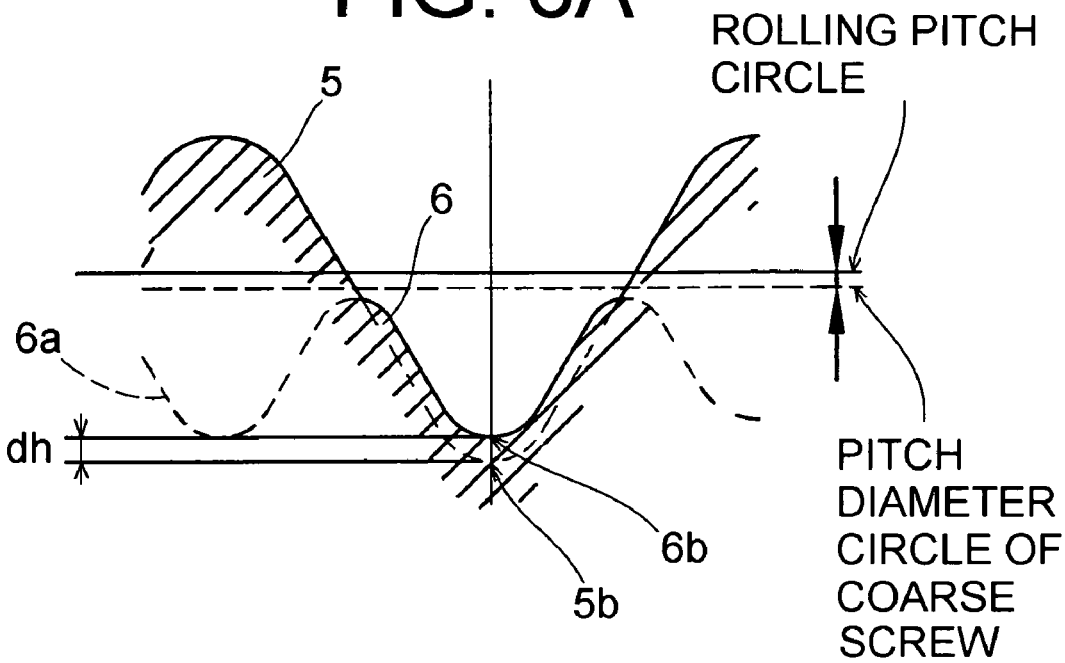
FIG. 6A is an enlarged partial view of a modified thread rolling die, corresponding to FIG. 5A.
Figure 6B:
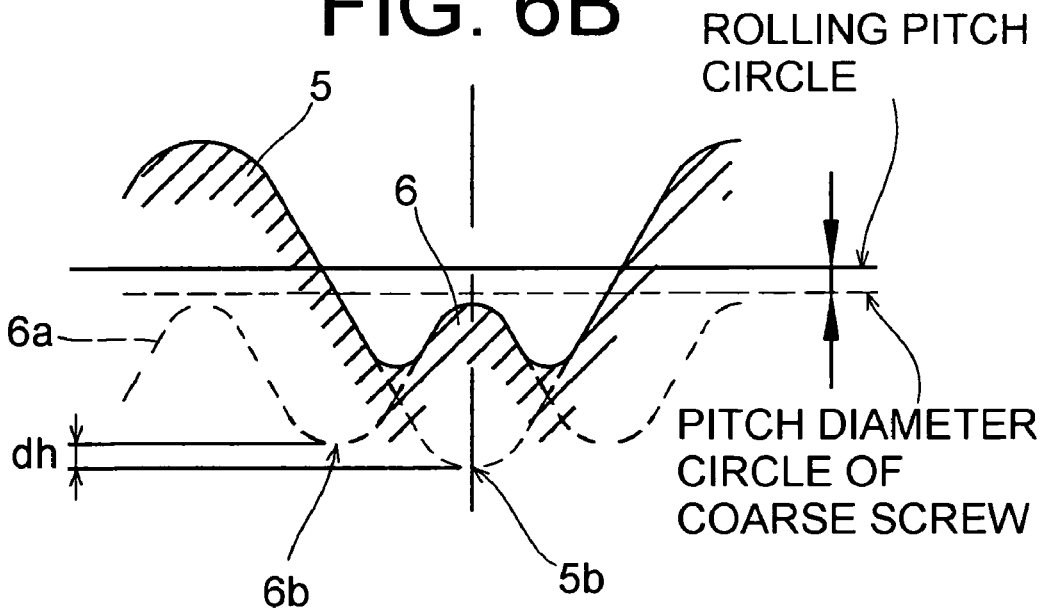
FIG. 6B is an enlarged partial view of the modified thread rolling die, corresponding to FIG. 5B.

Then, in the present embodiment, the projections 6 are desirably made of part of the fine thread 6*a* which appears cyclically at every (b) turns of the coarse thread according to a phase shift from the coarse thread when a fine screw is developed so that the root 6*b* of the fine screw developed lies in a position higher than the root 5*b* of the coarse thread. Here, as shown in FIGS. 6A and 6B, the fine screw to be developed shall be one that has a root depth 5% to 50% shallower than standards so that the root 6*b* of this fine screw developed lies in a position higher than the root 5*b* of the coarse thread as much as this amount of shallowing (dh).

Figure 7A:
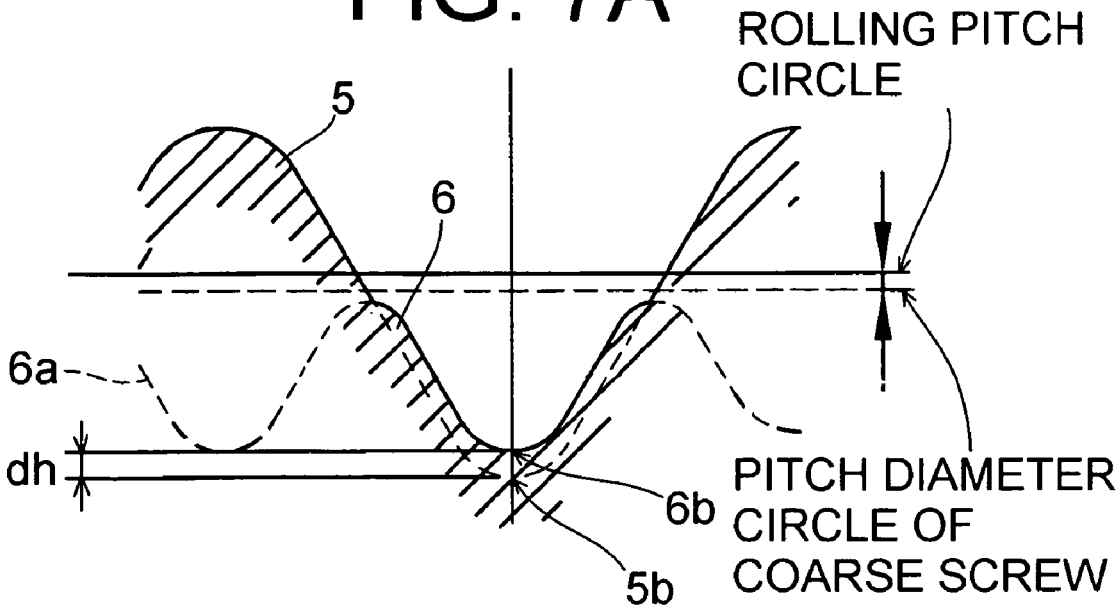
FIG. 7A is an enlarged partial view of a modified thread rolling die, corresponding to FIG. 5A.
Figure 7B:
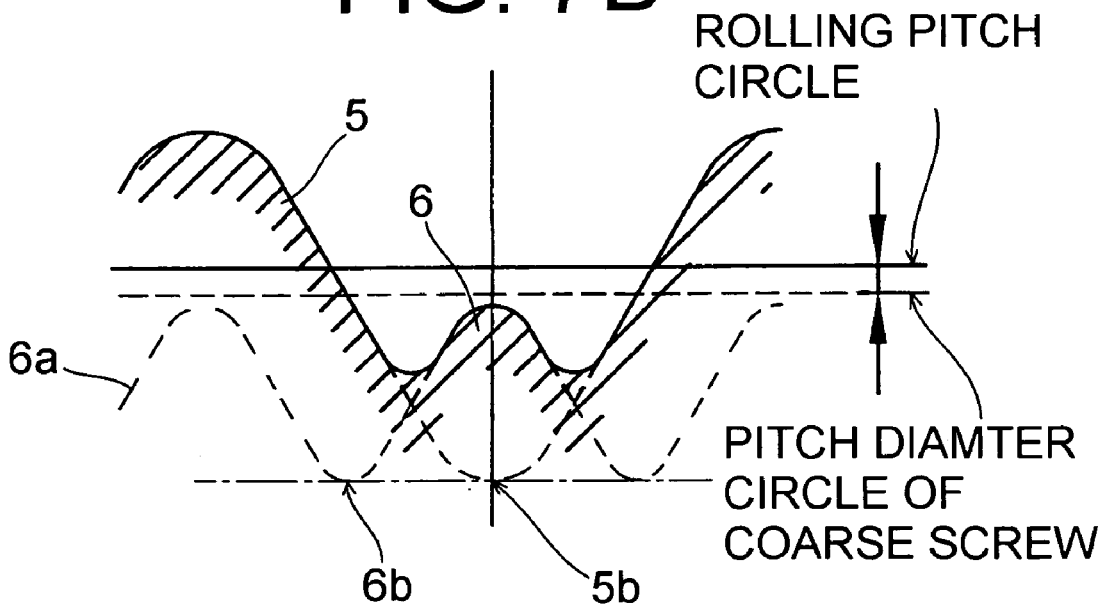
FIG. 7B is an enlarged partial view of the modified thread rolling die, corresponding to FIG. 5B.

Alternatively, as shown in FIGS. 7A and 7B, the fine screw to be developed shall be one that has a root depth 5% to 50% shallower than standards in the areas where the position of the root 5*b* of the coarse thread and the position of the root 6*b* of the fine thread 6*a* of the fine screw developed to form the projections 6 overlap the most with each other (the A—A section), and smoothly changes into a standard root depth in the areas where the positions of the two differ the most (the D—D section).

When a double screw bolt is rolled with these thread rolling dies modified, the rolling pitch circle diameter in the A—A section moves toward the inside of the work 3 approximately half as much as the amount of shallowing (dh) of the depth of the root 6*b* of the fine screw developed, and thus approaches the rolling pitch circle diameter in the D—D section accordingly, as compared to the case of rolling by using standard dies. This decreases variations of the rolling pitch circle diameter in the final phase of machining, thereby reducing fluctuations in the position of the rotation center of the work 3. Besides, since the sectional area of the groove portion in the A—A section approaches the sectional area of the groove portion in the D—D section, the material filling factors to the groove portions in the respective sections become uniform, thereby allowing significant suppression of chatter vibrations.

Meanwhile, in the double screw bolt rolled by using these thread rolling dies modified, the thread height of the fine screw portion naturally becomes smaller than in standards (particularly at areas corresponding to the A—A section). This causes little loss in static strength and dynamic fatigue strength, though, and even allows a sufficient anti-loosening effect because double screw bolts gain most of their fastening forces from coarse screw portions thereof.

By the way, when a double screw bolt is rolled by using the thread rolling dies modified as described above, it is possible to solve the problems of chatter vibrations and the like occurring in the case of rolling by using standard dies, whereas the fine screw portion of the manufactured double screw bolt becomes smaller than standards in thread height. A perfect thread height may sometimes be required of the fine screw portion, however, in view of the strength of the fine screw portion, the ease of engagement of fine screw nuts, or merchantability.

Figure 8A:
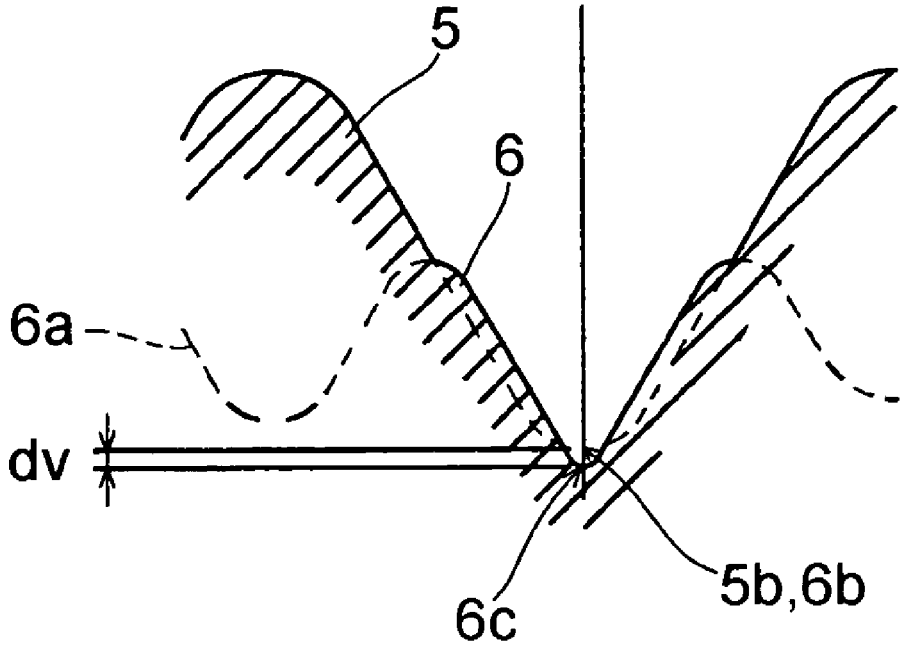
FIG. 8A is an enlarged partial view of a modified thread rolling die, corresponding to FIG. 5A.
Figure 8B:
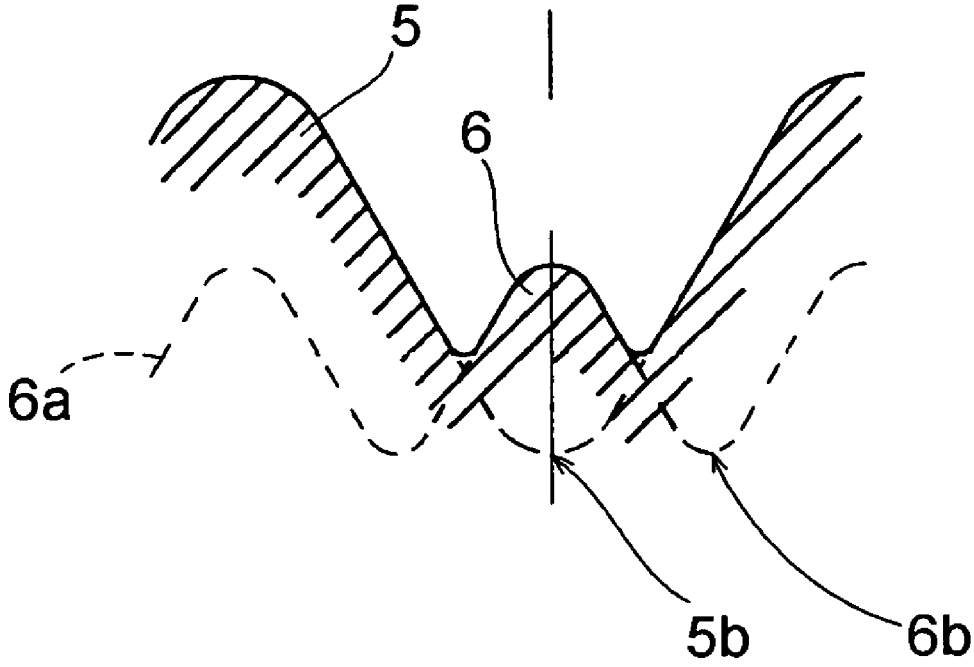
FIG. 8B is an enlarged partial view of the modified thread rolling die, corresponding to FIG. 5B.

In this case, the thread rolling dies are configured to have a groove 6*c* further into the root 6*b* of part of the fine thread 6*a* that appear as the projections 6 as shown in FIGS. 8A and 8B. This groove 6*c* has a depth (dv) 3% to 10% the height of the fine thread 6*a*. In rolling a double screw bolt with these thread rolling dies, the groove 6*c* functions a dashpot, so that a double screw bolt having a fine thread of standard height can be manufactured even when the work 3 is not filled into the groove portions of the thread rolling dies completely. This also makes it possible to suppress chatter vibrations in the final phase of machining, which occur from such factors as complete filling.

(Embodiment 2)

Figure 9:
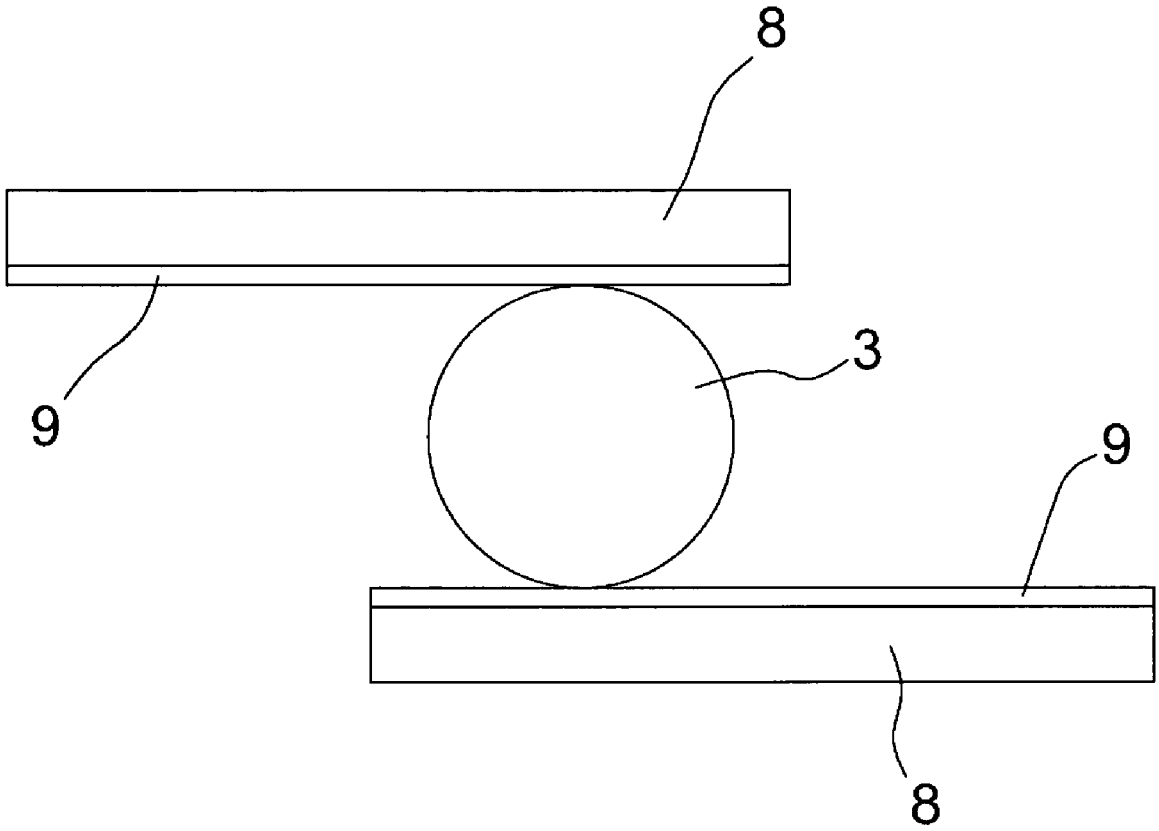
FIG. 9 is a schematic diagram showing the apparatus for manufacturing a double screw bolt according to a second embodiment of the present invention.
Figure 10A:
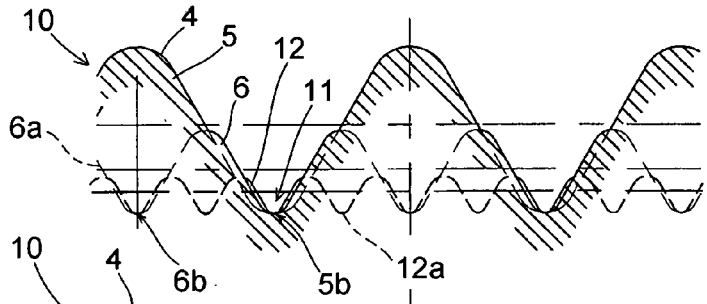
FIGS. 10A, 10B, 10C, 10D, 10E, and 10F are sectional views of a thread rolling die for a triple screw bolt according to a third embodiment of the present invention.
Figure 10B:
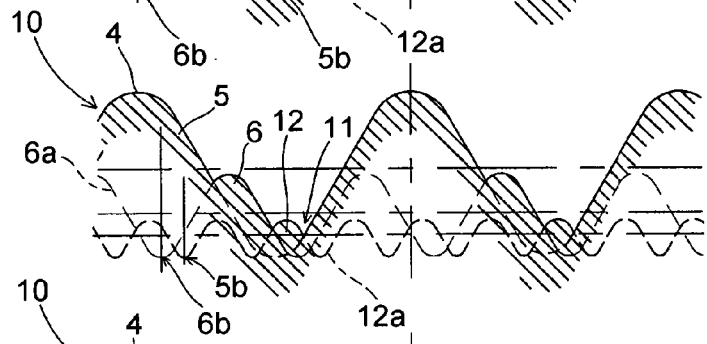
Figure 10C:
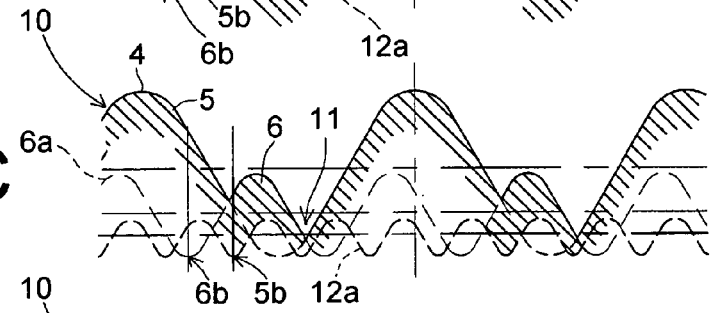
Figure 10D:
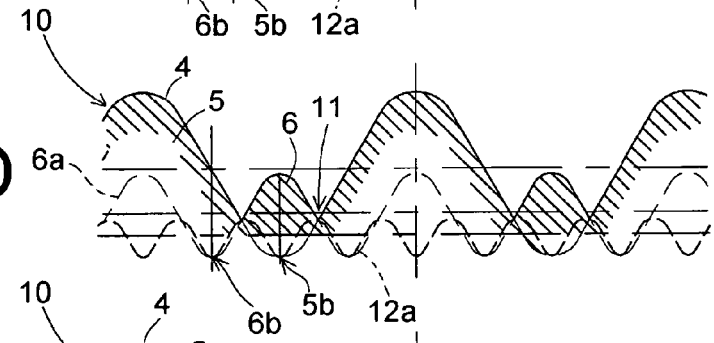
Figure 10E:
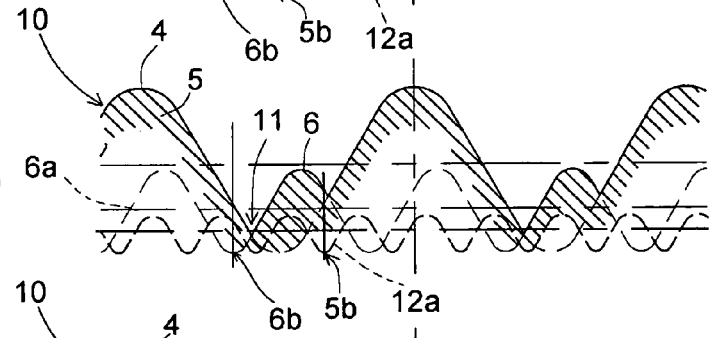
Figure 10F:
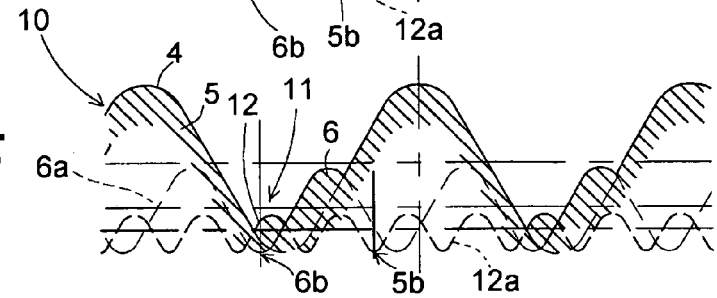
Figure 11A:
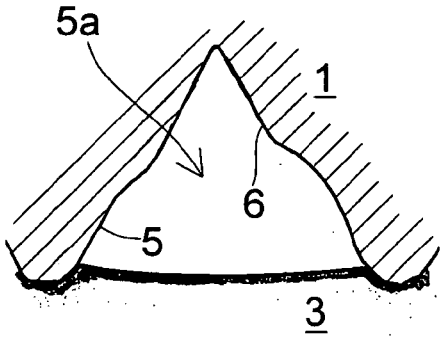
FIGS. 11A, 11B, 11C, 11D, 11E, 11F, 11C, and 11H are diagrams showing the states of flow of material in the A—A section of FIG. 3.
Figure 11E:
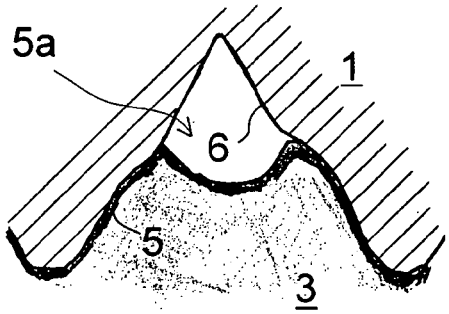
Figure 11B:
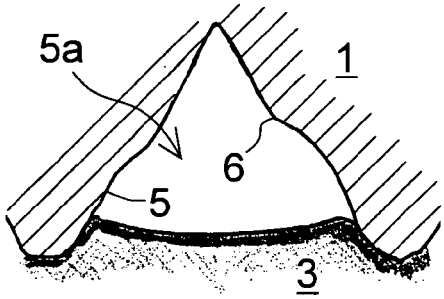
Figure 11F:
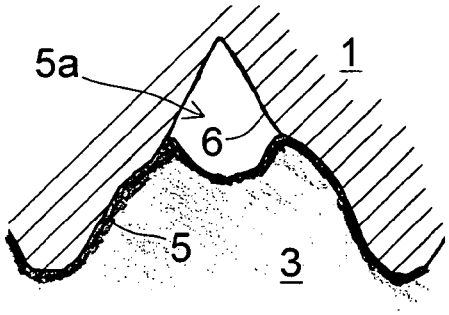
Figure 11C:
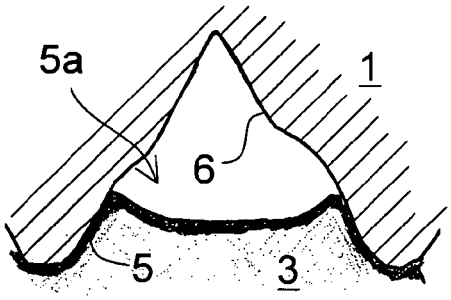
Figure 11G:
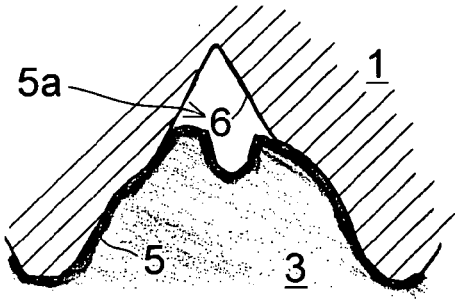
Figure 11D:
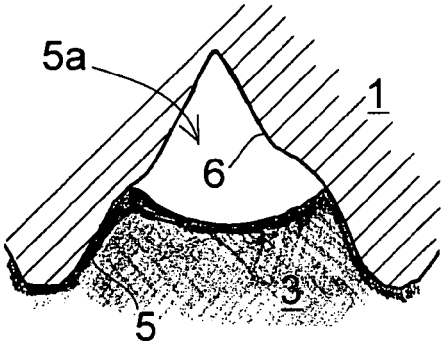
Figure 11H:
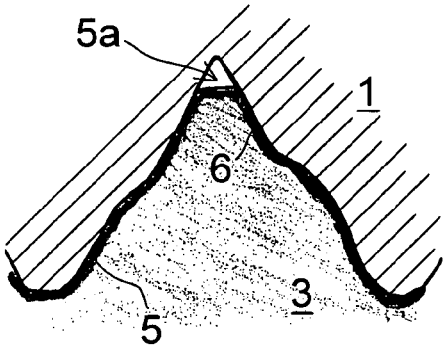
Figure 12A:
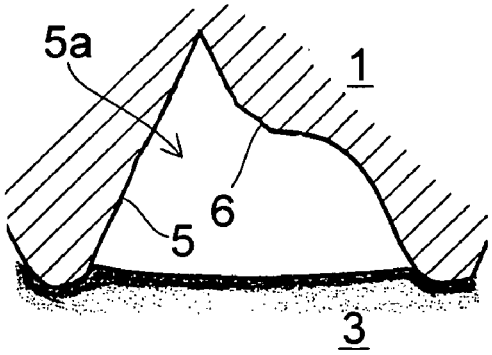
FIGS. 12A, 12B, 12C, 12D, 12E, 12F, 12C, and 12H are diagrams showing the states of flow of material in the B—B section of FIG. 3.
Figure 12B:
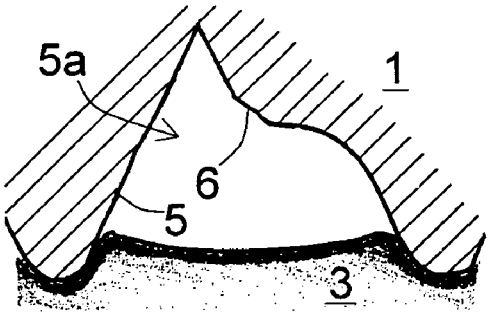
Figure 12C:
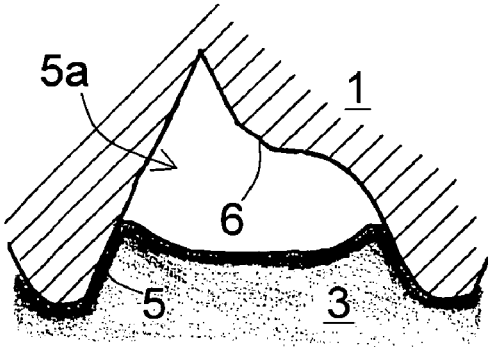
Figure 12D:
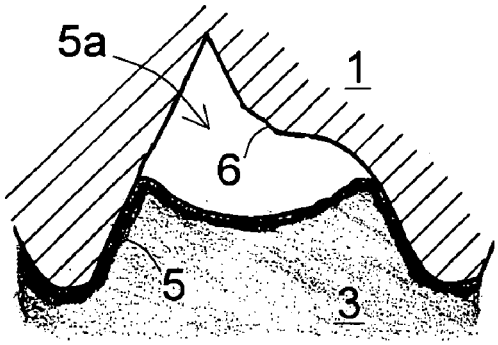
Figure 12E:
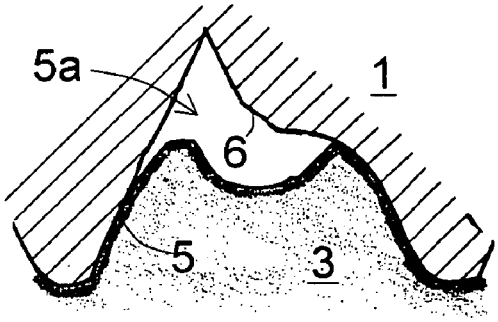
Figure 12F:
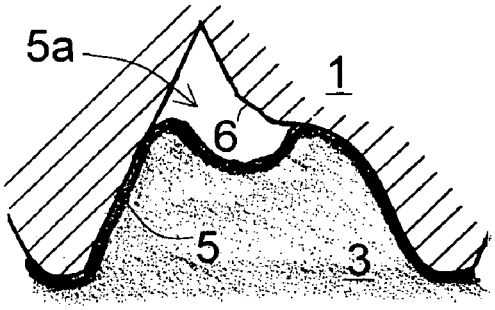
Figure 12G:
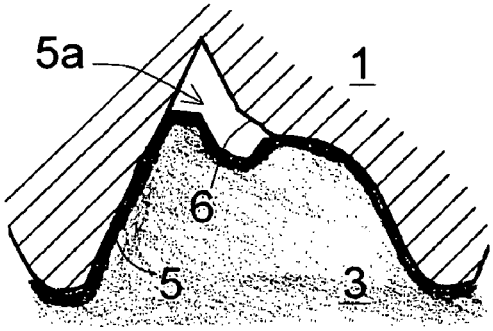
Figure 12H:
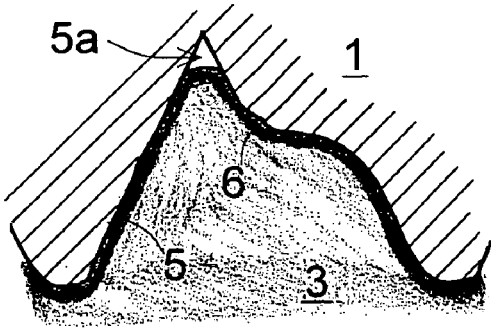
Figure 13A:
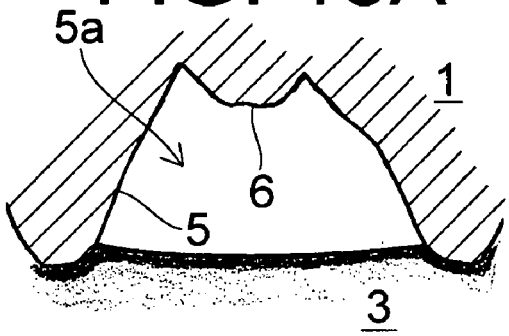
FIGS. 13A, 13B, 13C, 13D, 13E, 13F, 13C, and 13H are diagrams showing the states of flow of material in the D—D section of FIG. 3.
Figure 13E:
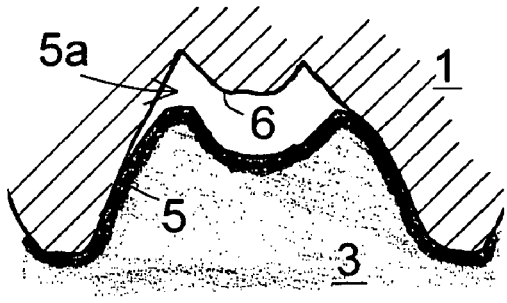
Figure 13B:
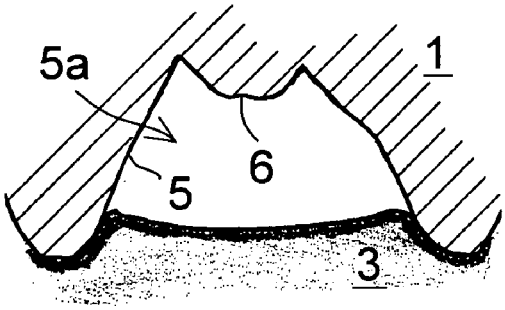
Figure 13F:
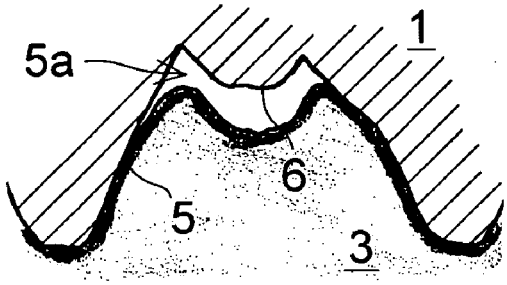
Figure 13C:
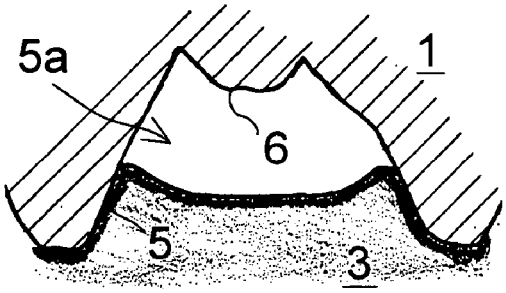
Figure 13G:
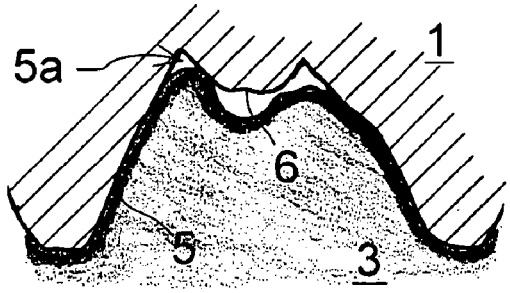
Figure 13D:
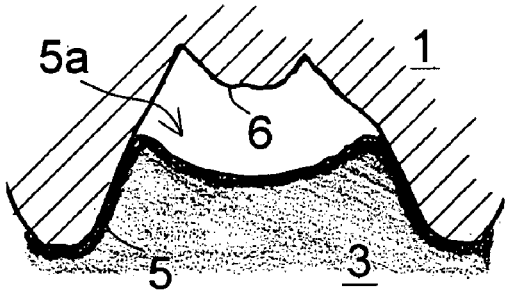
Figure 13H:
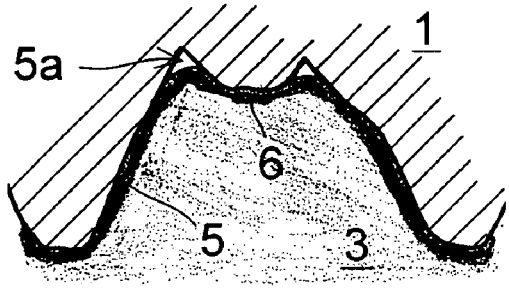

FIG. 9 is a schematic diagram showing the apparatus for manufacturing a double screw bolt according to a second embodiment of the present invention.

As shown in FIG. 9, the apparatus for manufacturing a double screw bolt according to the present embodiment has a pair of thread rolling dies 8 which are opposed to each other at a predetermined interval. One of the pair of thread rolling dies 8 is fixed and the other is arranged to be capable of parallel movement, or both are arranged to be capable of parallel movement in opposite directions.

The thread rolling dies 8 are plate-like dies (flat dies) having a transfer pattern 9 for forming a double screw bolt on one side. The transfer pattern 9 is one identical to the transfer pattern 4 according to the first embodiment, developed on a plane.

To manufacture a double screw bolt by using this apparatus for manufacturing a double screw bolt, a cylindrical work 3 is pressed between the pair of thread rolling dies 8. One of the thread rolling dies 8 is moved in parallel while maintained in parallel with the other thread rolling die 8, or both are moved in parallel in opposite directions. Consequently, as in the first embodiment, part of the coarse thread and part of the fine thread are transferred to the peripheral surface of the work 3 in a single step at a time, whereby a double screw bolt having part of a coarse screw portion and part of a fine screw portion is obtained.

(Embodiment 3)

FIGS. 10A, 10B, 10C, 10D, 10E, and 10F are sectional views of a thread rolling die 10 for a triple screw bolt according to a third embodiment of the present invention. A transfer pattern corresponding to the triple screw bolt to manufacture is formed to repeat 16 times per round on the periphery of the thread rolling die 10. FIGS. 10A to 10F are diagrams showing cross-sections of the periphery of the thread rolling die 10 at intervals of 3.75 degrees.

As shown in FIGS. 10A to 10F, the thread rolling die 10 for a triple screw bolt further has projections 12 that are made of part of a finest thread (shown by a dashed line (imaginary line) 12*a* in FIGS. 10A to 10F) which appears cyclically on root portions 11 formed by the coarse thread portion 5 and the projections 6 at every (c) turns (in the shown example, each single turn) of the coarse thread according to phase shifts from the coarse screw portion 5 and the projections 6 when a finest screw having a helical line in the same direction as that of the original coarse screw of the coarse thread developed and a pitch even smaller than that of the original fine screw for forming the projections 6 (where the ratios among the pitches of the coarse screw, the fine screw, and the finest screw are (a) to (b) to (c); (a), (b), and (c) are in minimum integer ratios. In the shown example, 4 to 2 to 1) is developed.

As shown in FIGS. 10A to 10F, the fine thread 6*a* appears as additional projections 6, only at portions that protrude from the coarse thread. Besides, in this thread rolling die 10, the finest thread 12*a* appears as the additional projections 12, only at portions that protrude from these projections 6. The projections 12 are not the finest thread itself, but projections protruded further from the coarse thread portion 5 and the projections 6 so as to correspond to the imaginary line 12*a* of the finest thread as much as the respective amounts of shift according to phase shifts from the coarse screw portion 5 and the projections 6.

Incidentally, although not shown in the drawings, an n-fold screw bolt can be rolled by using thread rolling dies that have: part of a coarse thread formed by developing a coarse screw; and projections made of part of each of fine threads which appear cyclically on a root portion of the coarse thread at every (n) turns of the coarse thread according to phase shifts from the coarse thread when one or a plurality of fine screws having helical lines in the same direction as that of the coarse screw and respective different pitches smaller than that of the coarse screw (where the ratios among the pitches of the coarse screw and the one or plurality of fine screws are (a) to . . . to (n); (a), . . . , and (n) are in minimum integer ratios) are developed.

Incidentally, the thread rolling dies for rolling this n-fold screw bolt are also subject to the same modifications as is the case with the thread rolling dies according to the first embodiment. To modify the root depth, it is possible to employ part of a fine thread which appears cyclically at every (n) turns of the coarse thread according to a phase shift from the coarse thread when the fine screw having the smallest pitch is developed so that the root of the fine screw developed lies in a position higher than the root of the coarse thread.

(Practical Example 1)

The mechanism for transferring a double screw to a bolt was analyzed by using the apparatus for manufacturing a double screw bolt according to the first embodiment of the present invention described above. FIGS. 11A to 11H, FIGS. 12A to 12H, and FIGS. 13A to 13H are diagrams showing the states of flow of material in the A—A section, the B—B section, and the D—D section of FIG. 3, respectively. Incidentally, in FIGS. 11A to 11H, FIGS. 12A to 12H, and FIGS. 13A to 13H, A to H show situations where the pair of thread rolling dies 1 were rotated in the same direction while the distance therebetween was decreased continuously, in steps of approximately 0.1 to 0.2 mm until the thread rolling dies 1 were finally pressed into the work 3 by approximately 1 mm.

As shown in FIGS. 11A to 11H, 12A to 12H, and 13A to 13H, as the thread rolling dies 1 were pressed into the work 3 gradually, the work 3 made plastic deformation initially along the surfaces of the coarse thread portions 5 of the thread rolling dies 1 to fill up the root portions 5*a* of the coarse threads. After it filled halfway, it then made plastic deformation along the surfaces of the projections 6 protruded further from the coarse threads to fill up the root portions 5*a*. As a result, a double screw bolt having part of the coarse screw portion and part of the fine screw portion was obtained.

(Practical Example 2)

A comparison test on the manufacturing of double screw bolts was conducted by using modified thread rolling dies and standard dies according to the first embodiment of the present invention described above. Table 1 shows the results of measurements of chatter vibrations and noise during machining, on both two types of nominal diameters M12 and M16, for situations where the depth of the root 6*b* of the fine thread was changed and where the depth of the groove 6*c* was changed. Here, the thread rolling dies used to manufacture the M12 double screw bolts had a pitch ratio of 1.75 to 0.875, and M16 a pitch ratio of 2 to 1.

TABLE 1

| Type of thread rolling die | Root depth | Groove depth | Chatter vibrations | Noise |
|---|---|---|---|---|
| Standard die | 0% | 0% | High | High |
| Modified die 1 | 5% | 0% | Medium | Medium |
| Modified die 2 | 10% | 0% | Low | Low |
| Modified die 3 | 20% | 0% | No vibrations | Low |
| Modified die 4 | 40% | 0% | No vibrations | Low |
| Modified die 5 | 0% | 5% | Medium | Medium |
| Modified die 6 | 0% | 10% | Medium | Medium |

As can be seen from Table 1, the modified thread rolling dies in which the depth of the root 6*b* of the fine thread was changed decreased in chatter vibrations and noise during machining as the depth of the root 6*b* was reduced to be 5% to 40% shallower than that of a fine thread according to standards. Meanwhile, the modified thread rolling dies in which the depth of the groove 6*c* was changed showed improvements in chatter vibrations and noise during machining when the groove 6*c* was given a depth 5% and 10% the height of a fine thread according to standards.

Incidentally, all of these thread rolling dies passed a loosening test according to National Aircraft Standard NAS-3354 vibration test method. From a static strength test based on the Amsler tensile strength test method and a dynamic strength test based on a hydraulic servo test method, it was also confirmed that they had capabilities equivalent to those of standard screw bolts.

INDUSTRIAL APPLICABILITY

The present invention is useful in manufacturing a multiple screw bolt having an anti-loosening function by rolling.

The invention claimed is:

1. A method of manufacturing a bolt by pressing a bolt material against thread rolling dies for rolling, wherein at least one of said thread rolling dies has a thread portion of a coarse thread formed by developing a coarse screw, and projections corresponding to a fine thread which appears cyclically on a root portion of said coarse thread at every (b) turns of said coarse thread according to a phase shift from said coarse thread when a fine screw having a helical line in the same direction as that of said coarse screw and a pitch smaller than that of said coarse screw (where a ratio between the pitches of said coarse screw and said fine screw is (a) to (b); (a) and (b) are in a minimum integer ratio) is developed so that its root lies in a position higher than a root of said coarse thread.

2. A method of manufacturing a bolt by pressing a bolt material against thread rolling dies for rolling, wherein at least one of said thread rolling dies has a thread portion of a coarse thread formed by developing a coarse screw, and projections corresponding to each of fine threads which appear cyclically on a root portion of said coarse thread at every (n) turns of said coarse thread according to phase shifts from said coarse thread when one or a plurality of fine screws having helical lines in the same direction as that of said coarse screw and respective different pitches smaller than that of said coarse screw (where ratios among the pitches of said coarse screw and said one or plurality of fine screws are (a) to . . . to (n); (a), . . . , and (n) are in minimum integer ratios) are developed, respectively (where the fine screw having a smallest pitch is developed so that its root lies in a position higher than that of a root of said coarse thread).

3. The method of manufacturing a bolt according to claim 1, wherein the root of said fine screw developed is positioned higher than the root of said coarse thread by 5% to 50% a height of the fine thread according to standards.

4. The method of manufacturing a bolt according to claim 2, wherein the root of said fine screw developed is positioned higher than the root of said coarse thread by 5% to 50% a height of the fine thread according to standards.

5. An apparatus for manufacturing a bolt by pressing a bolt material against thread rolling dies for rolling, wherein at least one of said thread rolling dies has a thread portion of a coarse thread formed by developing a coarse screw, and projections corresponding to a fine thread which appears cyclically on a root portion of said coarse thread at every (b) turns of said coarse thread according to a phase shift from said coarse thread when a fine screw having a helical line in the same direction as that of said coarse screw and a pitch smaller than that of said coarse screw (where the ratio between the pitches of said coarse screw and said fine screw is (a) to (b); (a) and (b) are in a minimum integer ratio) is developed so that its root lies in a position higher than a root of said coarse thread.

6. An apparatus for manufacturing a bolt by pressing a bolt material against thread rolling dies for rolling, wherein at least one of said thread rolling dies has a thread portion of a coarse thread formed by developing a coarse screw, and projections corresponding to each of fine threads which appear cyclically on a root portion of this coarse thread at every (n) turns of said coarse thread according to phase shifts from said coarse thread when one or a plurality of fine screws having helical lines in the same direction as that of said coarse screw and respective different pitches smaller than that of said coarse screw (where ratios among the pitches of said coarse screw and said one or plurality of fine screws are (a) to . . . to (n); (a), . . . , and (n) are in minimum integer ratios) are developed, respectively (where the fine screw having a smallest pitch is developed so that its root lies in a position higher than that of a root of said coarse thread).

7. The apparatus for manufacturing a bolt according to claim 5, wherein the root of said fine screw developed is positioned higher than the root of said coarse thread by 5% to 50% a height of the fine thread according to standards.

8. The apparatus for manufacturing a bolt according to claim 6, wherein the root of said fine screw developed is positioned higher than the root of said coarse thread by 5% to 50% a height of the fine thread according to standards.

9. A thread rolling die comprising: a thread portion of a coarse thread formed by developing a coarse screw; and projections corresponding to a fine thread which appears cyclically on a root portion of said coarse thread at every (b) turns of said coarse thread according to a phase shift from said coarse thread when a fine screw having a helical line in the same direction as that of said coarse screw and a pitch smaller than that of said coarse screw (where ratio between the pitches of said coarse screw and said fine screw is (a) to (b); (a) and (b) are in a minimum integer ratio) is developed so that its root lies in a position higher than a root of said coarse thread.

10. The thread rolling die according to claim 9, wherein the root of said fine screw developed is positioned higher than the root of said coarse thread by 5% to 50% a height of a fine thread according to standards.

11. A multiple screw bolt formed by pressing a bolt material against the thread rolling die according to claim 10 for rolling.

12. A multiple screw bolt formed by pressing a bolt material against the thread rolling die according to claim 9 for rolling.

13. A thread rolling die comprising: a thread portion of a coarse thread formed by developing a coarse screw; and projections corresponding to each of fine threads which appear cyclically on a root portion of said coarse thread at every (n) turns of said coarse thread according to phase shifts from said coarse thread when a plurality of fine screws having helical lines in the same direction as that of said coarse screw and respective different pitches smaller than that of said coarse screw (where ratios among the pitches of said coarse screw and said plurality of fine screws are (a) to . . . to (n); (a), . . . , and (n) are in minimum integer ratios) are developed, respectively (where the fine screw having a smallest pitch is developed so that its root lies in a position higher than that of a root of said coarse thread).

14. The thread rolling die according to claim 13, wherein the root of said fine screw developed is positioned higher than the root of said coarse thread by 5% to 50% a height of a fine thread according to standards.

15. A multiple screw bolt formed by pressing a bolt material against the thread rolling die according to claim 14 for rolling.

16. A multiple screw bolt formed by pressing a bolt material against the thread rolling die according to claim 13 for rolling.

* * * * *